US008863634B1

(12) United States Patent
Lou

(10) Patent No.: US 8,863,634 B1
(45) Date of Patent: Oct. 21, 2014

(54) LIGHTWEIGHT IMPACT ABSORBING ARMOR PANEL

(75) Inventor: Ken-An Lou, Phoenix, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 227 days.

(21) Appl. No.: 13/172,754

(22) Filed: Jun. 29, 2011

Related U.S. Application Data

(60) Provisional application No. 61/360,849, filed on Jul. 1, 2010.

(51) Int. Cl.
*F41H 5/04* (2006.01)

(52) U.S. Cl.
USPC ..... 89/36.02; 89/36.08; 89/36.09

(58) Field of Classification Search
USPC ..... 89/36.01, 36.02, 36.05; 264/50
See application file for complete search history.

(56) References Cited

U.S. PATENT DOCUMENTS 4,404,889 A * 9/1983 Miguel ..... 89/36.02
5,349,893 A * 9/1994 Dunn ..... 89/36.05
6,698,331 B1 * 3/2004 Yu et al. ..... 89/36.02
7,078,443 B2 7/2006 Milliren
2007/0029690 A1 * 2/2007 Green et al. ..... 264/50
2009/0320676 A1 * 12/2009 Cronin et al. ..... 89/36.05
2010/0251883 A1 10/2010 Naroditsky

OTHER PUBLICATIONS

Yehia A. Bahei-El-Din, Behavior of Sandwich Plates Reinforced with Polyurethane/Polyurea Interlayers under Blast Loads, Journal of Sandwich Structures and Materials, May 2007, pp. 261-281, vol. 9, Sage Publications.

* cited by examiner

*Primary Examiner* — Daniel J Troy
*Assistant Examiner* — John D Cooper
(74) *Attorney, Agent, or Firm* — James L Farmer

(57) ABSTRACT

Designs and methods are provided for a multi-layer panel capable of mitigating the transmission of a high energy impulse to the hull of the vehicle. In one exemplary embodiment, the blast panel comprises a first penetration resistant layer on the side facing away from the vehicle, a first core made of a crushable structural material between the first penetration resistant layer and the vehicle, and a shock dissipation layer disposed between the first penetration resistant layer and the first core.

23 Claims, 3 Drawing Sheets

LIGHTWEIGHT IMPACT ABSORBING ARMOR PANEL

This invention was made with government support under contract no. N00014-09-M-0349 awarded by the U.S. Navy Office of Naval Research. The government has certain rights in the invention.

TECHNICAL FIELD

The present invention generally relates to protective armor panels. For example, the technical field may comprise armor panels used for shielding the exterior surfaces of vehicles. Such vehicle panels may include those that are particularly adapted for protecting the occupants of a vehicle in the event of an under-vehicle mine blast. An armor panel within the field may further comprise a panel intended to mitigate or reduce the amount of energy from an explosive or ballistic event that is transmitted through the armor panel to an underlying surface or body.

DESCRIPTION OF THE EMBODIMENTS

Figure 1:
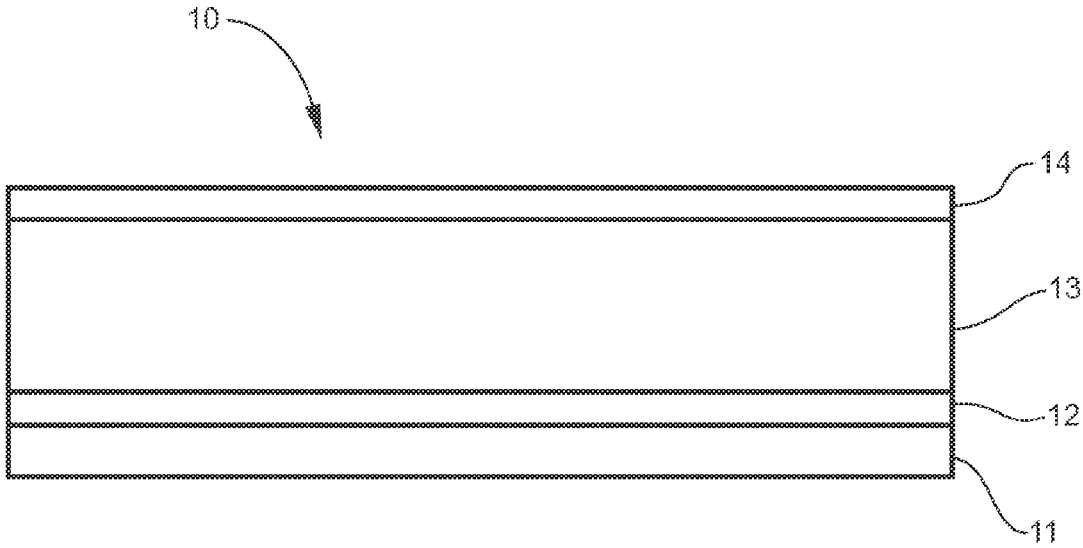
FIG. 1 is a cross section of an exemplary multi-layer impact absorbing armor panel.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

The term "armor" refers to a construction configured to stop or neutralize ballistic projectiles such as bullets, shells, shrapnel or fragments (i.e. projectiles which were intentionally projected towards an object to at least injure or damage). Example materials normally used as armor layers are metals, metal alloys, plastics, fiber composites or fiberglass, aramid (Kevlar™, Dyneema™). The term "foam and/or gel or soft rubber" refers to materials which, though being foams, gels, soft rubber and materials made of gel and foam, are still hard enough to retain its shape and the shape of perforations with which they are produced, under normal conditions of usage.

Referring now specifically to the drawing figures, an exemplary lightweight impact absorbing panel 10 is illustrated in FIG. 1. The panel 10 comprises a penetration resistant layer 11, a shock dissipation layer 12, a core 13, and a backing layer 14. The panel 10 is intended to be oriented such that the penetration resistant layer 11 faces the direction of the high energy threat, and the backing layer 14 faces the protected article. For example, in the case of a panel 10 used for vehicle mine blast protection, the panel could be mounted underneath the vehicle and oriented such that penetration resistant layer 11 faces down, toward the ground, and backing layer 14 faces up, toward the vehicle. The panel 10 is designed to absorb or otherwise mitigate a substantial portion of the energy impulse imparted to a structure in such events. Compared to a monolithic metallic armor plate with the same areal density, an exemplary panel 10 may reduce the amount of energy transmitted through the panel to an underlying structure by at least 30 percent. The applications of panel 10 are not limited to explosive blasts however, and may further include the capability of mitigating or defeating threats in the form of high speed ballistic projectiles, or other high energy threats.

The penetration resistant layer 11 may be any appropriate material capable of preventing an anticipated high energy threat from rupturing or penetrating through penetration resistant layer 11 and reaching the shock dissipation layer 12. Suitable materials may include for example lightweight and high strength metals such as titanium and aircraft grade aluminums; as well as various rigid composites such as fiberglass and graphite composites. In one exemplary embodiment the penetration resistant layer 11 is an anti-ballistic composite comprising multiple stacked layers of high performance fibers.

In one exemplary embodiment the penetration resistant layer 11 comprises a multi-layer stack of unidirectional fiber ballistic fabric layers, consolidated under heat and pressure into a rigid or semi-rigid composite. The fabric layers may be any high-tensile strength fabric such as are known for making ballistic resistant articles. Suitable commercially available products include fabrics made from aramid fibers such as those sold under the trademark Kevlar®, fabrics made from ultra-high molecular weight polyethylene fibers such as those sold under the trademarks Spectra® and Dyneema®, and fabrics made from polyphehylenebenzobisoxazole (PBO) fibers such as those sold under the trade name Zylon®. As used in this application, the terms "high performance fiber", "high strength fibers", and "ballistic fibers" refers to fibers having a tensile strength greater than 7 grams per denier.

In an exemplary process of fabricating a penetration resistant layer 11, a bonding film is applied to a uniform flattened layer of parallel fibers to form a stable unidirectional sheet. Layers of the coated unidirectional fabric are stacked in a cross plied arrangement, such as so-called 0/90 degree cross ply, or any other angular relationship or combination of angular relationships. The stacked layers are consolidated into a semi-rigid ballistic composite under heat and pressure. The bonding film may be selected to permit flexure of the fabric layers when struck by a shock wave or ballistic object.

Enhanced protective characteristics may be obtained while optimizing use of materials in the composite. Specifically, it has been determined that a lightweight ballistic composite can be constructed of high performance ballistic fibers in the absence of adhesive resins and conventional matrix materials to hold the fibers together. By omitting the resin, the arrays of fibers directly contact each other, instead of being encapsulated and therefore separated from each other by the resin. For example, an ultra-thin film may be used both to cover the cross-plied arrays and to hold the arrays to each other. In one particular embodiment the percentage by weight of high strength fibers in the penetration resistant layer 11 is at least 80% of the total weight of the ballistic composite. One such ballistic composite is sold under the name T-Flex® HA by TechFiber LLC of Chandler Ariz.

The shock dissipation layer 12 is positioned behind the penetration resistant layer 11, and acts to mitigate the effect of a localized impulse on the underlying panel layers, and/or underlying surfaces or bodies shielded by the panel 10. Without intending to be tied to any particular theory of operation, impulse mitigation may occur through energy absorption, dispersion, reflection, redirection, transformation, or by various combinations of these, or any other means. In one embodiment, a layer 12 may be any of various materials that react to a localized impulse by redirecting and spreading, or dispersing the impulse over a larger surface area. For example, highly porous materials such as rigid and semi-rigid foams are typically energy dissipating materials to some extent. Such foam layers typically have sufficient rigidity to transmit at least a portion of the impact energy from localized impact site to lateral or adjacent regions of the foam layer before the energy is transmitted to an underlying body or layer. The result is to spread the impact force over a larger area and thereby reduce the force per unit area experienced by the underlying layers.

In one particular embodiment the shock dissipation layer 12 comprises relatively soft materials that exhibit elastic or viscoelastic behavior. Such materials include for example various foams, gels, rubbers, and other materials that return rapidly to approximately the original dimensions and shape after substantial deformation. For example, an exemplary soft material suitable for shock dissipation layer 12 may exhibit the following mechanical properties: a density of less than 18 lb./ft 3 when tested in accordance with ASTM 3574; a compression set of less than 2% when tested in accordance with ASTM 1667; a compression set of less than 10% when tested in accordance with ASTM 3574; a tear strength of 10 lbs/in minute when tested in accordance with ASTM D-624; an elongation of 80% when tested in accordance with ASTM 3574; a tensile strength of 55 psi when tested in accordance with ASTM 3574; a Shore A hardness of 15; a compression force deflection of 9±2 psi when tested in accordance with ASTM 3574; and an energy return of between about 35 to 41% in a drop weight impact test. It will be understood that any material being a foam and/or gel or soft rubber, and having similar properties to those described above may be suitable for use in a shock dissipation layer of the present invention.

Suitable materials for shock dissipation layer 12 may include various porous elastic materials, such as elastomer foams. In one embodiment the layer 12 comprises a urethane type porous elastomeric foam, and more particularly a polyurethane foam. Polyurethane foams are thermoset materials made from either polyester or polyether-type compounds that can be made soft and flexible or firm and rigid at equivalent densities. One such suitable, commercially available material is an air frothed polyurethane foam sold by Kemmler Products Inc, Mooresville, USA under the trade name "SHOCKtec Air2Gel® HD FR". The FR designation refers to fire retardant chemicals incorporated during the manufacturing process. For protecting against explosive impulse loads such as may occur from an under vehicle mine blast, a suitable shock dissipation layer 12 may comprise a layer of polyurethane foam sheet in a thickness range of approximately ⅛ to ⅜ inches.

In another embodiment the shock dissipation layer 12 may comprise shear-thickening compounds. Shear thickening materials increase in viscosity with increasing shear rates, resulting in an almost instantaneous increase in stiffness. Again without intending to be limited by any particular theory of operation, the stiffening effect may act to redirect and/or spread a localized shock load over a larger area. One such commercially available material is a semi-rigid impact resistant foam product manufactured by D30, located in Brighton & Hove, UK. The D30 material is understood to incorporate a shear-thickening (or dilatant fluid) compound that has been encapsulated in an elastomeric microcellular foam matrix. The material is moldable, and available in various thicknesses and shapes. In addition to the SHOCKtec and D30 products, additional suitable, polymer foam materials are commercially available, such as for example various foam products sold by Palziv in Israel.

The core 13 may be any lightweight material that deforms or crushes upon impact, thereby consuming a portion of the impact energy transmitted to an underlying surface or body. The structural core 13 may also serve as a structural element of the panel 10, resisting the compression and shear loads imparted to the core when the panel undergoes bending or deflection. In one embodiment the physical attributes of the core material include light weight, high rigidity in the z (panel thickness) direction, and good shear strength in the x-y plane.

A wide array of materials may be utilized to meet the energy absorbing and structural needs of a core material, such as for example metallic or polymeric foam materials including Rohacell® structural foam sold by Evonik Industries, balsa wood, and various engineered structures known as honeycomb. Honeycomb is a flexible or rigid structural material that comprises a plurality of closely packed geometric cells that together form a lightweight honeycomb-shaped structure having high specific stiffness, high specific strength, and energy-absorbing characteristics. The geometric shape of honeycomb cells forming a core 13 may be any regular shape such as square and hexagonal, or alternatively over-expanded structures of various geometric shapes. Also suitable are reinforced honeycomb and other regular or irregular cellular frameworks.

The cells forming a honeycomb core 13 may be fabricated from a variety of rigid and flexible materials. For example, the cells may be formed from an aramid (aromatic polyamide)

material such as Nomex®, a flame retardant meta-aramid material; Korex®, a high-strength para-aramid paper material; or Kevlar® aramid fiber honeycomb, each manufactured by E.I. duPont de Nemours and Company of Wilmington, Del. Other suitable materials non-exclusively include metals, such as aluminum, metal alloys, carbon, fiberglass, thermoplastic materials, such as polyurethane, and other materials conventionally known by those in the art for the formation of such honeycomb-shaped structures.

Each grade of honeycomb is characterized by a number of factors, including the type and strength of the honeycomb material, cell configuration, cell size and frequency, alloy and foil gauge (if an aluminum honeycomb), and density. In one exemplary embodiment core 13 comprises metal honeycomb with cell sizes in the range of 1/16 in. to ½ inch, and with cell wall thickness ("foil gauge") in the range of about 0.001 in. to 0.005 inches. In one specific embodiment the structural core 13 is a 304 stainless steel ¼ in. square cell, 0.003 foil gauge honeycomb sold by Benecor, Inc. in Wichita Kans.

Metal foam is another class of crushable structural materials suitable for core 13. A metal foam is a cellular structure consisting of a solid metal, frequently aluminium, containing a large volume fraction of gas-filled pores. The pores can be sealed (closed-cell foam), or they can form an interconnected network (open-cell foam). The defining characteristic of metal foams is a very high porosity, where typically 75-95% of the volume consists of void spaces. Metal foams exhibit good energy absorption characteristics, and unlike some polymer foams remain deformed after impact. They are light (typically 10-25% of the density of the metal they are made of, which is usually aluminium) and relatively stiff.

Various aluminum foam products suitable for core 13 are commercially available. For example, in one embodiment a core 13 comprises a plain aluminum foam panel, 0.5 g/cc density, sold by Alu-light America L.P. in Newark, Del. A metal foam core 13 may also comprise a metal foam sandwich panel clad with metal face sheets made of aluminum, steel, stainless steel, or titanium for example. In one particular embodiment the core 13 is a sandwich panel sold by Alu-light America LP that comprises a 0.5 g/cc density, Al—Si—Mg aluminum foam clad with Al-3103 aluminum face sheets. Other potential core materials include for example a crushable foam made of microspheres of glass, rigid plastic, or some other material; granulated particles of alumina (Al2O3) in a consolidated form sold under the trade name CRUSH-MAT®; end grain balsa wood; and pumice composite.

The panel 10 may further include a backing layer 14 adhered to the core 13 on the side opposite the shock dissipation layer 12. A backing layer 14 may serve to protect the core from damaging gasses, as well as providing structural integrity to the panel in conjunction with the penetration resistant layer 11 and core 13. The backing layer 14 may be made of various rigid materials, including metals, composites, or an anti-ballistic composite such as the materials discussed in reference to penetration resistant layer 11. Suitable metals include for example stainless steels or aluminum alloys in which the maximum plastic strain occurs at failure. In one embodiment the backing layer 14 is made of a material exhibiting sufficient levels of both flexibility and ductility to deform as the core crushes without failing. The backing layer 14 may also comprise the metal cladding of a metal foam sandwich core construction discussed above in reference to core 13.

Figure 2:
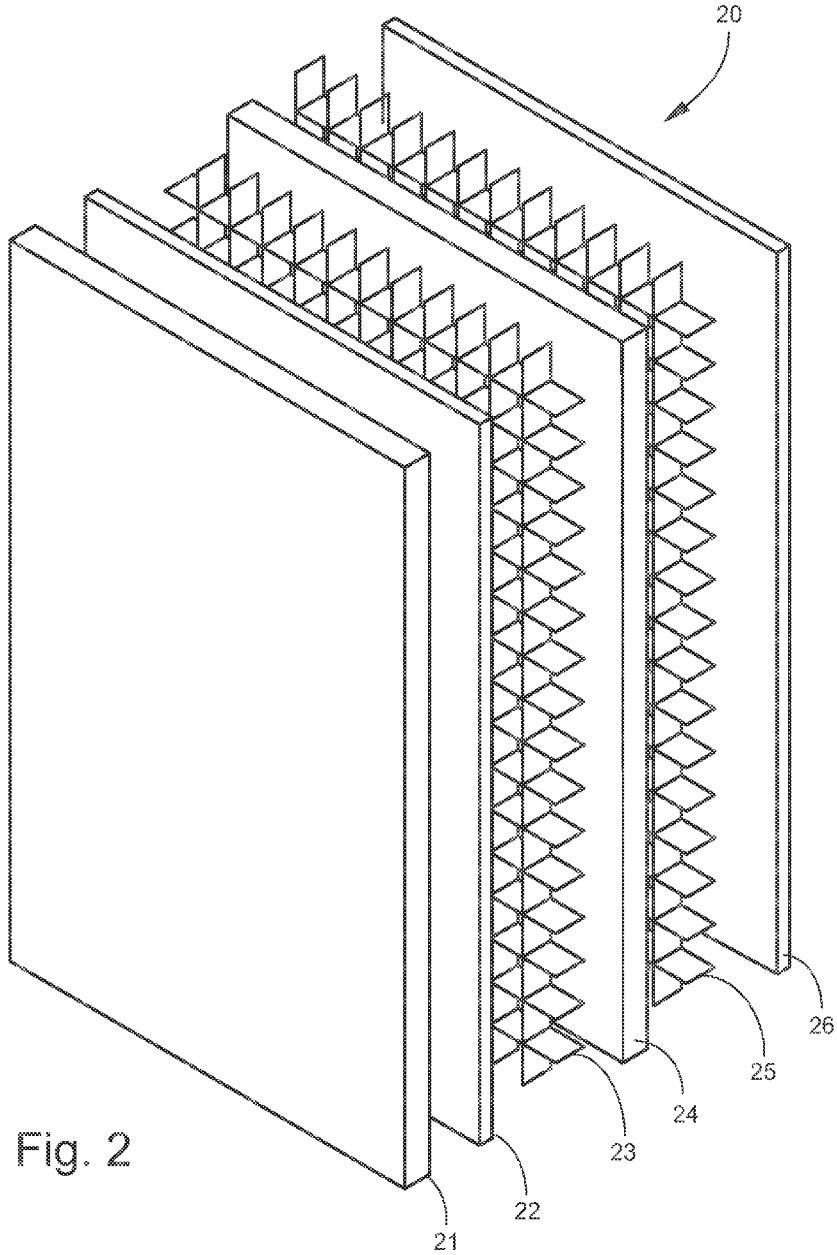
FIG. 2 is an exploded perspective view of a multi layer impact absorbing armor panel with two honeycomb cores separated by a rigid panel.

FIG. 2 depicts one particular example of a lightweight multi-layer energy absorbing panel in accordance with the present invention. Beginning from the threat side, the exemplary panel 20 comprises: a first protective layer 21 of ¼ inch thick T-Flex HA ballistic fabric composite; a shock dissipation layer 22 of ⅛ inch thick SHOCKtec Air2Gel® HD FR polyurethane foam; a first core 23 of 0.3 inch thick 304 stainless steel, ¼ in. square cell, 0.003 foil gauge, honeycomb; a second protective layer 24 comprising ¼inch thick T-Flex HA ballistic fabric composite; a second core 25 of 0.3 inch thick 304 stainless steel, ¼ in. square cell, 0.003 foil gauge, honeycomb; and a backing layer 26 of ⅛ inch thick T-Flex HA ballistic fabric composite. The total thickness of the panel 21 is 1.33 inches, and the areal density is 5.28 lb./ft$^2$.

Figure 3:
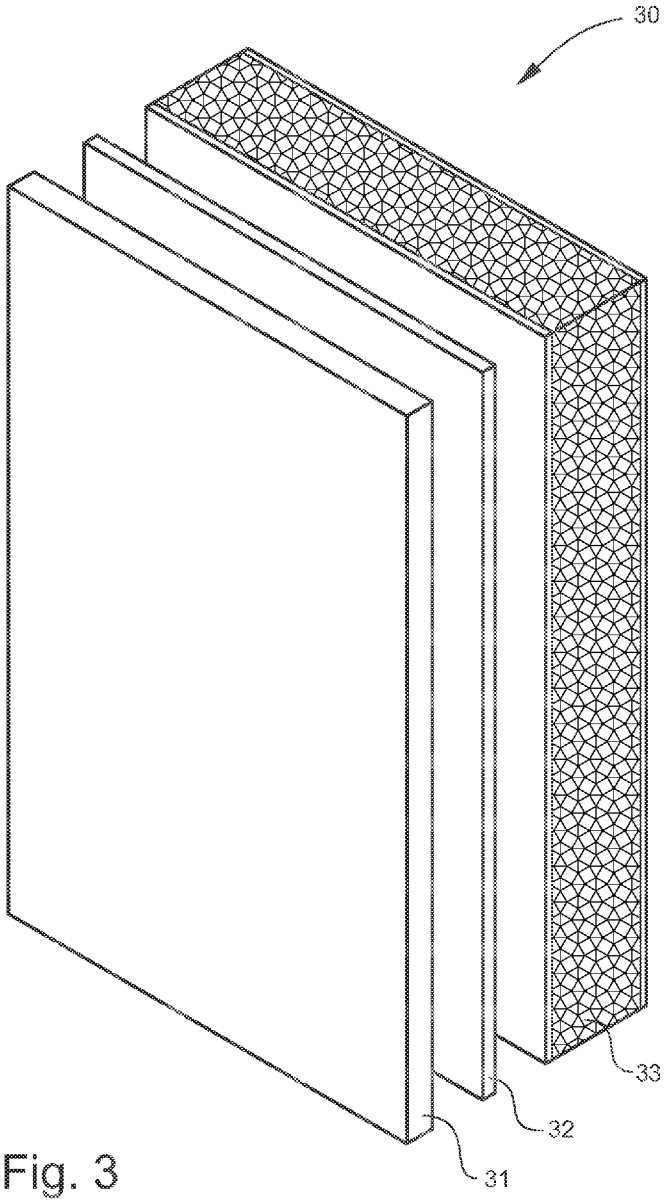
FIG. 3 is and exploded perspective view of another multi-layer impact absorbing armor panel with a core comprising aluminum foam clad with metal skins.

FIG. 3 illustrates another particular example of a lightweight multi-layer energy absorbing panel in accordance with the present invention. Beginning again from the threat side, the exemplary panel 30 comprises: a first protective layer 31 of ¼ inch thick T-Flex HA ballistic fabric composite; a shock dissipation layer 32 of ⅛ inch thick SHOCKtec Air2Gel® HD FR polyurethane foam; and a core 33 comprising a 1 inch thick aluminum foam sandwich panel made from 0.5 g/cc density, Al—Si—Mg aluminum foam clad with 2 mm Al-3103 aluminum face sheets.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself

What is claimed is:

1. A multi-layer energy absorbing panel attached to an outer surface of a vehicle hull for protection against explosive blasts, comprising:

a first penetration resistant layer made of a multi-layer stack of anti-ballistic fabric on a side of the panel distal from the vehicle hull and configured to be exposed to a potential explosive blast;

a first core made of a crushable structural material disposed between the first penetration resistant layer and the vehicle hull; and exclusive of any adhesive layers, a shock dissipation layer made of a porous elastomeric urethane between the first penetration resistant layer and the first core, the shock dissipation layer having sufficient thickness to mitigate the effect of a localized explosive impulse on the first core by spreading the impulse over a substantially larger area.

2. The multi-layer energy absorbing panel of claim 1, wherein the shock dissipation layer has a compression set of less than about 2% when tested in accordance with ASTM 1667.

3. The multi-layer energy absorbing panel of claim 1, wherein the shock dissipation layer is an air-frothed polyurethane gel.

4. The multi-layer energy absorbing panel of claim 1, wherein the first core is selected from the group comprising metal foam and structural honeycomb.

5. The multi-layer energy absorbing panel of claim 4, wherein the first core is a closed-cell aluminum foam.

6. The multi-layer energy absorbing panel of claim 5, wherein the first core is a sandwich structure comprising an aluminum foam core and sheet aluminum cladding.

7. The multi-layer energy absorbing panel of claim 1, further comprising a backing layer attached to the side of the first core opposite the shock dissipation layer.

8. The multi-layer energy absorbing panel of claim 7, wherein the backing layer is a ductile material.

9. The multi-layer energy absorbing panel of claim 7, wherein the backing layer is a ballistic composite material.

10. The multi-layer energy absorbing panel of claim 1, wherein the fabric layers comprise unidirectional high performance fibers.

11. A multi-layer blast panel attached to the underside of a vehicle hull for mitigating the transmission of an under-vehicle explosive impulse to the vehicle hull, comprising:

a first penetration resistant layer on a side of the panel distal from the vehicle hull and configured to be exposed to a potential explosive impulse;

a first core made of a crushable structural material between the first penetration resistant layer and the vehicle hull; and exclusive of any adhesive layers, a shock dissipation layer made of an elastomeric air-frothed polyurethane disposed between the first penetration resistant layer and the first core, the shock dissipation layer having sufficient thickness to mitigate the effect of a localized explosive impulse on the first core by spreading the impulse over a substantially larger area.

12. The multi-layer blast panel of claim 11, wherein the shock dissipation layer returns rapidly to approximately its original dimensions and shape after substantial deformation.

13. The multi layer blast panel of claim 11, wherein the shock dissipation layer has an energy return of between about 35 to 40% in a drop weight impact test.

14. The multi layer blast panel of claim 13, wherein the shock dissipation layer further has a compression set of less than about 2% when tested in accordance with ASTM 1667.

15. The multi-layer blast panel of claim 11, wherein the first core is a closed-cell aluminum foam.

16. The multi-layer blast panel of claim 11, further comprising a backing layer between the core and the vehicle hull.

17. The multi-layer blast panel of claim 16, wherein the first core is a sandwich structure comprising an aluminum foam core with aluminum cladding, and the backing layer is the cladding on the side closest to the vehicle hull.

18. The multi-layer blast panel of claim 11, wherein the penetration resistant layer comprises a multi-layer stack of anti-ballistic fabric.

19. The multi-layer blast panel of claim 18, wherein the fabric layers comprise unidirectional high performance fibers.

20. A multi-layer energy absorbing panel attached to an outer surface of a vehicle hull for protection against explosive blasts, comprising:

a first penetration resistant layer on a side of the panel distal from the vehicle hull and configured to be exposed to a potential explosive blast;

a first core made of a crushable structural material disposed between the first penetration resistant layer and the vehicle hull; and exclusive of any adhesive layers, a shock dissipation layer between the first penetration resistant layer and the first core, the shock dissipation layer made of an air-frothed polyurethane gel with an energy return of between about 35 to 40% in a drop weight impact test, and a compression set of less than about 2% when tested in accordance with ASTM 1667, the shock dissipation layer having sufficient thickness to mitigate the effect of a localized explosive impulse on the first core by spreading the impulse over a substantially larger area.

21. The multi-layer energy absorbing panel of claim 20, wherein the shock dissipation layer further has an elongation of about 80% when tested in accordance with ASTM 3574.

22. The multi-layer energy absorbing panel of claim 21, wherein the shock absorbing layer further has a tear strength of about 10 pounds per inch-minute when tested in accordance with ASTM D-624.

23. The multi-layer energy absorbing panel of claim 22, wherein the shock absorbing layer further has a tensile strength of about 55 psi when tested in accordance with ASTM 3574.

* * * * *